United States Patent [19]

Backlund

[11] 4,188,261

[45] Feb. 12, 1980

[54] METHOD OF IMPROVING THE HOMOGENEITY OF LIGNOCELLULOSE CONTAINING MATERIAL

[75] Inventor: Sture O. E. Backlund, Sundsvall, Sweden

[73] Assignee: SCA Development Aktiebolag, Sweden

[21] Appl. No.: 826,568

[22] Filed: Aug. 22, 1977

Related U.S. Application Data

[63] Continuation-in-part of Ser. No. 673,691, Apr. 5, 1976, abandoned.

[30] Foreign Application Priority Data

Apr. 18, 1975 [SE] Sweden ..... 7504526

[51] Int. Cl.[2] ..... D21C 3/22; D21C 7/12

[52] U.S. Cl. ..... 162/42; 162/61; 162/249

[58] Field of Search ..... 162/42, 61, 237, 248, 162/249, 250

[56] References Cited

U.S. PATENT DOCUMENTS

| | | | |
|---|---|---|---|
| 2,179,796 | 11/1939 | Morterud | 162/248 |
| 2,845,347 | 7/1958 | Byrne | 162/248 X |
| 3,793,137 | 2/1974 | Backlund | 162/42 |
| 3,907,631 | 9/1975 | Backlund | 162/42 |

*Primary Examiner*—Arthur L. Corbin

*Attorney, Agent, or Firm*—Lerner, David, Littenberg & Samuel

[57] ABSTRACT

A method for improving the homogeneity of ligno-cellulose containing materials during digestion in a digester is disclosed. Specifically, the ligno-cellulose containing material and cooking liquor are charged to the digester, a portion of the cooking liquor is drawn off from the digester and heated, preferably in a calorisator, and the heated liquor is divided into two portions, the first portion being returned to the top of the digester, and the second portion being returned to the bottom of the digester, and boiling is caused to occur in the digester solely by terminating the flow of liquor into the top of the digester.

6 Claims, 1 Drawing Figure

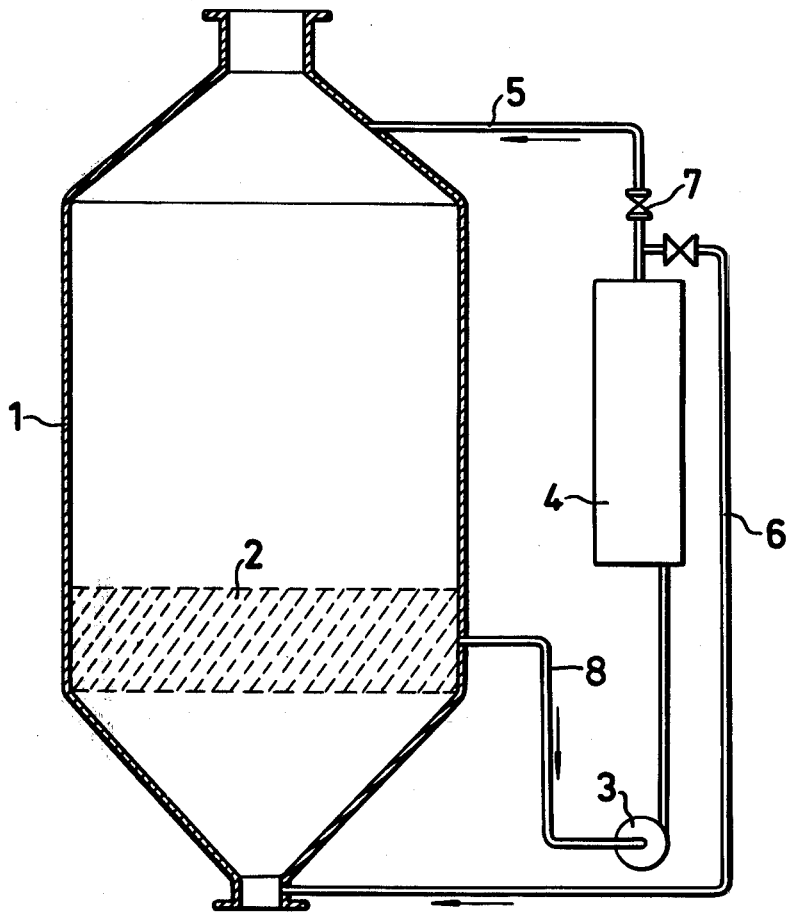
5
7
1
4
6
2
8
3

METHOD OF IMPROVING THE HOMOGENEITY OF LIGNOCELLULOSE CONTAINING MATERIAL

CROSS-REFERENCES TO RELATED APPLICATIONS

This application is a continuation in part of application Ser. No. 673,691 filed on Apr. 5, 1976, now abandoned for "Method of Improving the Homogeniety at Periodical Digestion of Ligno-Cellulose Containing Material" in the name of Sture Olof E. Backlund.

FIELD OF THE INVENTION

The present invention relates to a method of obtaining a homogeneous pulping during periodical digestion of a ligno-cellulose containing material in a digester. Specifically, the present invention relates to such method in which the cooking liquid is drawn off from the digester, heated in a calorisator, and returned to the top and bottom, respectively, of the digester.

BACKGROUND OF THE INVENTION

It is extremely important to obtain uniform digestion in pulp manufacturing processes, both from the viewpoint of economy and with respect to the quality of the pulp obtained. The reasons why non-uniform digestion is obtained vary in accordance with the type of process being utilized. In Swedish patent specificaton No. 345,885, some of the most significant factors which influence the homogeneity during periodic digestion are listed, and a method of eliminating the negative effects of one of the most significant of such factors, namely, the circulation of the cooking liquid.

The technique employed in accordance with that application is the heat boiling-up, and in accordance with that experiences in mill installations, extremely positive effects upon the homogeneity during digestion have been demonstrated. In accordance with this method, boiling of the cooking liquid is effected by rapidly decreasing the pressure in the digester in order to effect upward flow therein, and temperature balances in the digester. This is effected either by violent gassing or by the intake of cooling liquor to the top of the digester.

SUMMARY OF THE INVENTION

In accordance with the present invention, it has now been discovered that boiling can be effected in the digester by an entirely new method. Specifically, such boiling takes place by periodically heating only from the bottom of the digester. Specifically, in accordance with this method, the ligno-cellulose containing materials and cooking liquor are charged into the digester, at least a portion of the cooking liquor is drawn off from the digester, and this liquid is heated and divided into a first heated liquid portion and a second heated liquid portion, and the first heated liquid portion is returned to the top of the digester, while the second heated liquid portion is returned to the bottom of the digester, and boiling is effected in the digester solely by terminating the flow of the first heated portion into the top of the digester. By employing such a method, pressure drops in the digester are prevented, and the heating effected by the flow to the bottom of the digester results in boilings-up, which also results in distribution of heat to poorly heated zones therein.

In a preferred embodiment, this heating, when it is to be carried out within a reasonable time and without risk of extra incrustation in the calorisator for heating the liquid, requires that the conduit for returning the second portion of the heated liquid to the bottom of the digester has a sufficiently large diameter so that increased circulation flow rates during boiling-up are provided for, that is since the total amount of cooking liquor drawn off from the digester remains substantially constant.

By employing such a method, a far simpler installation, which is considerably cheaper than those previously known methods which employ boiling, while at the same time a very uniformly digested pulp, having a low shives content is obtained.

After the initiation of digestion, the first boiling-up is preferably carried out when the chlorine number of the pulp is between 30 and 20, that is, when the delignification first begins to become substantial, but before any substantial delignification has occurred. The total number of boilings-up, and the time interval between them, are adjusted in accordance with the digestion schedule in question, so that during the entire boiling process when delignification takes place, the greatest possible heat homogeneity is obtained in the digester.

The total duration of these boilings may vary, but should be at least about ten seconds. Normally, boilings will occur for from about 1 to 30 minutes, preferably from about 2 to 20 minutes, and most preferably from about 4 to 10 minutes. In order to obtain efficient boiling by this process, it is most preferred that the conduit which effects circulation of the second portion of the heated liquid to the bottom of the digester must be of a sufficient size so that the bottom circulation flow rate during boiling-up is from about 1 to 15 $m^3$/min, preferably from about 2 to 12 $m^3$/min, and most preferably from about 3 to 8 $m^3$/min. In addition, it is preferred that the digester be degassed during boiling.

By periodically closing the flow of the second portion of the heated liquid to the bottom of the digester after boiling has occurred, an increase in the circulation of the first portion of the heated liquid to the top of the digester is effected after boiling-up, which result is favorable for the digesting process as a whole.

In a preferred embodiment, in order to reduce the packing of the digester contents, the flow of the first portion of the heated liquid to the top of the digester can be periodically limited prior and/or subsequent to boiling-up.

BRIEF DESCRIPTION OF THE FIGURE

The FIGURE shows a schematic representation of an apparatus for carrying out the method of the present invention.

DETAILED DESCRIPTION

In accordance with the FIGURE, a digester 1 is provided, having a circulation system for indirect heating therein. The circulation system thus comprises a strainer girdle 2 which is connected by conduit 8 to a circulation pump 3 for drawing off liquid from the digester 1. This liquid is then passed through a calorisator 4 for heating thereof, and the heated liquid from the calorisator is then circulated to both the top and the bottom of the digester 1. This is effected through conduits 5 and 6, respectively. Thus, in the conduit 5, for recirculation of the heated liquid to the top of the digester 1, a valve 7 is provided which preferably is controlled automatically by a timer and/or temperature impulses. Similarly, in conduit 6, for recirculation of the heated liquid to the bottom of the digester 1, means are provided for controlling the flow through this conduit.

The present invention may be further illustrated by the following examples thereof.

EXAMPLE 1

Digestion was carried out in a periodic sulphate digester having a volume of 140 $m^3$. The digester was provided with a circulation system for indirect heating in accordance with the FIGURE. The digester was initially charged with about 25 tons of bone dry chips by means of a liquor packing method. Both white liquor and black liquor were charged in such an amount so that the total alkali charge was about 220 kg of active alkali (NaOH) per ton of absolutely dry wood, and so that the wood/liquid ratio was about 1/3.5. During the initial charging of these chips, the circulation pump 3 was already started, so that liquid was drawn out of the digester 1 through the strainer girdle 2. This cooking liquid was then circulated through the calorisator 4 for heating, and after the heating, 70% of the flow from the calorisator was returned to the top of the digester through conduit 5, while the remaining 30% was returned to the bottom of the digester through conduit 6.

After 70 minutes of operation, the digester had been heated to 170° C. in this manner by means of steam in the calorisator 4. When the temperature in the conduit 5 returning liquid to the top of the digester during heating of the charge had risen to about 155° C., an initial period of boiling-up was begun. This was effected by automatically closing valve 7 with a timer, which had been initially set at the start of digestion. In this manner, the recirculation of the heated liquid to the top of the digester was terminated, and the digester was thus heated only from recirculation through bottom conduit 6, now carrying all of the liquid drawn off from the digester by circulation pump 3. When this heating was begun, the boiling-up thus occurred solely by the termination of the flow of the heated liquid to the top of the digester, and, so that heat was spread to poorly heated zones within the digester. After ten minutes of boiling, valve 7 was reopened, and heating of the charge continued in the normal manner. The total charge was held at the maximum temperature of 170° C. for about fifty minutes, and was terminated by strongly gassing the top of the digester for ten minutes before blow-off. The blow-off time was 15 minutes. The chlorine number of the pulp obtained was 6, and the shives content as shown by the screening of an average sample from the charge in a Wennberg screen having a slit width of about 0.20 mm, was about 1.5%. For a similar charge which was digested in a normal manner, i.e., not in accordance with the method of the present invention, a shives content of 4.5% and a chlorine number of 6 was obtained.

EXAMPLE 2

A second digestion was carried out in the same type of digester as in Example 1, and at the same charge conditions, except that the wood/liquid ratio was about 1/3.0 instead of 1/3.5. The charge was again heated in the same manner as Example 1, this time up to 145° C., when the recirculation of the heated liguid to the top of the digester was reduced by about 15% by partially closing valve 7. When the temperature in the conduit 5 for recirculation to the top of the digester during heating of the charge had arrived at 155° C., boiling-up was carried out. This was effected by terminating recirculation of the heated liquid to the top of the digester by closing valve 7, so that again the charge was heated only from recirculation of the heated liquid through the conduit 6 to the bottom of the digester. After about 8 minutes, valve 7 was reopened to its position before boiling-up, i.e., its partially closed position. During contingent digestion, this throttling of the flow through conduit 5 to the top of the digester was maintained in order to reduce the packing of the chip bed.

The charge was maintained at a maximum temperature of about 170° C. for about 50 minutes, and was terminated with a strong top gassing for about 10 minutes prior to blow-off. Blow-off time was about 15 minutes. The chlorine number of the pulp obtained was about 5.5, and the shives content measured by screening an average sample from the charge in a Wennberg screen having a slit width of about 0.20 mm was about 1.4%. For a similar charge produced by a digester which was not employing the method of the present invention, a shives content of about 6.5 was obtained with a chlorine number of about 5.5.

EXAMPLE 3

A similar digestion was carried out in a periodic sulphate digester having a volume of about 125 $m^3$, again provided with a circulation system for indirect heating in accordance with the FIGURE. By employing a liquor packing method, the digester was charged with about 23 tons of bone dry chips. Both white liquor and black liquor were charged in an amount so that the total alkali charge was 200 kg active alkali (NaOH) per ton of absolutely dry wood, and the wood/liquid ratio was about 1/3.5. The circulation pump 3 was initiated during the chip charging stage, and drew off liquid from the digester through a strainer girdle 2.

This cooking liquid was circulated through the calorisator 4 for heating, and was then distributed after heating so that about 75% of the total volume of heated liquid was recirculated to the top of the digester through conduit 5, while the remaining 25% was recirculated to the bottom of the digester through conduit 6.

Heating to about 170° C. took place within about 150 minutes by this indirect heating with steam in the calorisator 4, and when the temperature in the conduit 5 to the top of the digester during heating of the charge had reached about 135° C., and initial boiling-up was carried out. This was effected by terminating recirculation of heated liquid to the top of the digester through conduit 5 by closing valve 7, and the digester was thus heated only from recirculation to the bottom of the digester through conduit 6. After about 8 minutes, valve 7 was reopened, and heating of the charge continued in a normal manner. A second boiling-up was carried out when the temperature of the charge had reached about 163° C., and a similar boiling-up time of about 8 minutes was utilized. The charge was held at a maximum temperature of about 170° C. for about one hour, and after the intake of about 10 $m^3$ of cooling liquor, the charge was blown off. Blow-off time was about 25 minutes.

The chlorine number of the pulp obtained was about 5.9, and the shives content employed by screening an average sample from the charge in a Wennberg screen having a slit width of about 0.20 mm was about 1.0%. A similar charge digested without employing the method of the present invention had a shives content of about 4.7% and a chlorine number of about 5.9.

What is claimed is:

1. A method for improving the homogeneity of ligno-cellulose containing materials during digestion thereof in a digester, which comprises charging said ligno-cellulose materials and a cooking liquor into said digester, drawing off a portion of said cooking liquor from said digester, heating said drawn off cooking liquor, dividing said heated cooking liquor into a first portion and a second portion, returning said first portion of said heated cooking liquor to the top of said digester, returning said second portion of said heated cooking liquor to the bottom of said digester, and causing boiling to occur in said digester for a period of from about 2 to 20 minutes solely by terminating the return of said first portion of said heated cooking liquor to the top of said digester, whereby an increased amount of said heated cooking liquor greater than the amount of said second portion of said heated cooking liquor is returned to the bottom of said digester, said increased amount of said heated cooking liquor being from about 1 to 15 $m^3$/min and comprising the total amount of said cooking liquor drawn off from said digester.

2. The method of claim 1 wherein the flow of said second portion of said heated cooking liquor to the bottom of said digester is from about 3 to 8 $m^3$/min when said flow of said first portion of said heated cooking liquor is terminated.

3. The method of claim 1 wherein the flow of said first portion of said heated cooking liquor to the top of said digester is periodically terminated to cause periodic boiling to occur in said digester.

4. The method of claim 1 wherein said boiling occurs for a period of from about 4 to 10 minutes.

5. The method of claim 1 wherein the flow of said first portion of said heated cooking liquor is terminated by valve means, and wherein said valve means is controlled by a timer.

6. The method of claim 1 wherein the flow of said first portion of said heated cooking liquor is resumed after said boiling has occurred, and the flow of said second portion of said heated cooking liquor is periodically terminated after said boiling has occurred so that the flow of said first portion of said heated cooking liquor is thereby increased.

* * * * *